US007399184B2

(12) United States Patent
Hester et al.

(10) Patent No.: US 7,399,184 B2
(45) Date of Patent: Jul. 15, 2008

(54) DRY ERASE ARTICLE

(75) Inventors: Jonathan F. Hester, Hudson, WI (US); Michael J. Annen, Hudson, WI (US); Brent R. Hansen, New Richmond, WI (US); Timothy L. Quinn, New Brighton, MN (US); John J. Emmel, Blaine, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 308 days.

(21) Appl. No.: 11/165,409

(22) Filed: Jun. 23, 2005

(65) Prior Publication Data

US 2006/0003307 A1 Jan. 5, 2006

Related U.S. Application Data

(60) Provisional application No. 60/585,014, filed on Jul. 2, 2004.

(51) Int. Cl.
*B43L 1/00* (2006.01)

(52) U.S. Cl. ..... 434/408

(58) Field of Classification Search ..... 434/247, 434/365, 408, 421, 430; 40/711; 428/355 RA
See application file for complete search history.

(56) References Cited

U.S. PATENT DOCUMENTS

| | | | | |
|---|---|---|---|---|
| 2,717,437 | A | | 9/1955 | De Mestral |
| 2,820,277 | A | | 1/1958 | Forster |
| 3,009,235 | A | | 11/1961 | De Mestral |
| 3,192,589 | A | | 7/1965 | Pearson |
| 3,270,408 | A | | 9/1966 | Nealis |
| 3,370,818 | A | | 2/1968 | Perr |
| 3,408,705 | A | | 11/1968 | Kayser et al. |
| 3,680,237 | A | * | 8/1972 | Finnerty, Sr. ..... 40/544 |
| 3,691,140 | A | | 9/1972 | Silver |
| 3,758,657 | A | | 9/1973 | Menzin et al. |
| 3,922,457 | A | | 11/1975 | Barnwell et al. |
| 4,140,565 | A | * | 2/1979 | Parker et al. ..... 156/219 |
| 4,775,310 | A | | 10/1988 | Fischer |
| 4,867,057 | A | | 9/1989 | Bradley et al. |
| 4,875,259 | A | | 10/1989 | Appeldorn |
| 4,996,110 | A | | 2/1991 | Tanuma et al. |
| 5,035,626 | A | * | 7/1991 | Persing ..... 434/408 |

(Continued)

FOREIGN PATENT DOCUMENTS

| | | |
|---|---|---|
| DE | 25 45 266 | 4/1977 |

(Continued)

*Primary Examiner*—Kurt Fernstrom

(57) ABSTRACT

The invention is a display article having a flexible substrate which includes a writing surface capable of being used as a dry erase surface. A peripheral edge extends around the writing surface. A flexible framing strip is affixed to the writing surface at a position proximate to the peripheral edge. One embodiment of the display article can be made by forming a substrate having a writing surface. The substrate defines a periphery edge, a back surface, and a plurality of mushroom shaped hooks extending from the back surface substantially over the entire back surface. The writing surface is capable of being used as a dry erase surface. At least a portion of the periphery of the writing substrate is folded over to form a framing strip having a plurality of exposed mushroom shaped hooks. The framing strip is secured to the writing surface.

24 Claims, 5 Drawing Sheets

U.S. PATENT DOCUMENTS 5,058,247 A 10/1991 Thomas et al.
5,077,870 A 1/1992 Melbye et al.
5,131,119 A 7/1992 Murasaki et al.
5,201,101 A 4/1993 Rouser et al.
5,207,581 A 5/1993 Boyd
5,212,853 A 5/1993 Kaneko
5,303,489 A * 4/1994 Blegen ..... 40/711
5,342,665 A 8/1994 Krawitz
5,359,794 A 11/1994 Wood
5,537,720 A 7/1996 Takizawa et al.
5,571,617 A 11/1996 Cooprider et al.
5,626,478 A * 5/1997 Gatlin ..... 434/247
5,682,695 A 11/1997 Hoffman
5,688,579 A 11/1997 Konsti et al.
5,800,760 A 9/1998 Takizawa et al.
5,824,748 A 10/1998 Kesti et al.
5,845,375 A 12/1998 Miller et al.
5,947,437 A 9/1999 Tate et al.
6,007,891 A 12/1999 Davis et al.
6,010,338 A * 1/2000 Watson ..... 434/81
6,022,599 A 2/2000 Rietveld et al.
6,076,238 A 6/2000 Arsenault et al.
6,105,502 A * 8/2000 Wagner et al. ..... 101/491
6,251,500 B1 6/2001 Varga et al.
6,341,856 B1 * 1/2002 Thompson et al. ..... 347/100
6,354,030 B1 * 3/2002 Harris ..... 40/711
6,464,507 B1 * 10/2002 Bailey ..... 434/247
6,578,304 B1 * 6/2003 Lytle ..... 40/711
6,620,500 B2 * 9/2003 Sweet et al. ..... 428/355 RA
6,660,352 B2 12/2003 Hsu et al.
6,735,896 B1 5/2004 Zager
6,908,651 B2 * 6/2005 Watanabe et al. ..... 428/36.5
6,945,785 B2 * 9/2005 Sohl et al. ..... 434/408
2002/0092626 A1 * 7/2002 Beall ..... 160/135
2002/0132079 A1 9/2002 Woods
2002/0189171 A1 12/2002 Parshad
2003/0008095 A1 1/2003 Meccia
2004/0081844 A1 4/2004 Bharti et al.
2004/0091849 A1 * 5/2004 Gallant et al. ..... 434/408
2004/0091869 A1 5/2004 Batra et al.
2004/0229202 A1 11/2004 Sohl et al.

FOREIGN PATENT DOCUMENTS

DE 36 33 570 4/1988
FR 2 485 903 1/1982
GB 2 334 237 8/1999
JP 08169198 7/1996
WO WO 97/12532 4/1997
WO WO 00/60974 10/2000
WO WO 2005/100006 10/2005

* cited by examiner

DRY ERASE ARTICLE

CROSS REFERENCE TO RELATED APPLICATION

This application claims the benefit of U.S. Provisional Patent Application No. 60/585,014, filed Jul. 2, 2004.

BACKGROUND OF THE INVENTION

The invention relates generally to articles having an erasable writing surface.

As commonly used, the term "dry erase" as applied to an article (e.g., a white board) refers to the ability to write or mark on that article with ink (e.g., using a felt tip marking pen), and later erase the ink without the need of a liquid cleaner. In practice, inks intended for use with dry erase surfaces are often specifically formulated for use with individual surface compositions, and may not be useful on all types of dry erase materials.

Dry erase articles are known in the art generally as articles having surfaces that a user may write upon using ink markers. The user may then erase written indicia using an eraser (e.g. a cloth or a felt pad).

Commonly available dry erase substrates (sometimes referred to as "dry erase boards" or "whiteboards") sold commercially comprise a rigid backing material, a front dry erasable surface, a stiff frame surrounding the edge of the dry erasable surface, a stiff tray positioned at the bottom for holding dry erase markers and erasers, and a mechanical attachment mechanism for mounting the product to a wall (e.g. screw-in mounting brackets). Typically, these products range in size from small (e.g. 8½ in×11 in) to very large (e.g. 48 in×96 in, and larger). The larger conventional dry erase products are disadvantaged in that they are heavy, and typically designed for permanent mounting on the wall, which makes them ill-suited for transportation to meetings and also for mounting on office partition walls. Also, these dry erase products are often difficult to mount, typically requiring the use of power tools. The smaller dry erase boards provide limited space for written material.

Exemplary dry erase boards using cured melamine resins are manufactured by GBC Office Products, Skokie, Ill., Boone International, Corona, Calif., and RoseArt Company, Wood Ridge, N.J. Exemplary dry erase boards using porcelain covered steel are available from GBC Office Products and Boone International. Exemplary dry erase articles using fluoropolymer film can be obtained from Walltalkers, Inc., Fairlawn, Ohio.

Boards designed to be carried and displayed at various locations are also commercially available. These boards are lighter than conventional dry erase boards, and some fold for transport. In addition, lighter boards specifically designed for mounting on office partition walls have been commercialized. These boards often feature hook and loop type or office partition type mounting attachments for securing the boards to vertical surfaces. The cost of these transportable boards can be quite expensive. The mobile and cubicle boards also have a number of shortcomings with respect to performance. Many of the mobile boards are only marginally easy to transport and require installation at the destination using either a wall-mounted rail or separate cubicle hooks. Additionally, these boards are stiff and awkward to carry, and the desire for a compact carrying size limits the available writing area. Moreover, transportability often means a loss of other desirable product features. For example, means to mount the boards, as well as means to store markers and erasers are often absent from the mobile products.

Examples of mobile dry erase surfaces include, the Boone® Off The Wall Modular System Dry Erase Boards, manufactured ACCO World Corporation, Lincolnshire, Ill. and the Quartet Cubicle Dry-Erase Board with Graphite Frame, manufactured by General Binding Corporation, Northbrook, Ill.

Dry erase surfaces formed on flexible sheeting are also known in the art. These surfaces allow for high ease of transportation of the surface. The thin sheet format of the surface allows the user to erroneously write past the edge of the sheet, which can cause the user to write on the underlying surface (e.g. a wall), resulting in unsightly marks. The thin sheets similarly do not adequately prevent accidental movement of the eraser past the edge of the sheet, which can result in unsightly "smudging" of the wall due to deposition of ink dust by the eraser. Additionally, means to mount the boards, as well as means to store markers and erasers are often absent from these products. The mounting mechanisms used often result in sagging of the sheet, due to the flexible nature of the surface.

Examples of flexible sheeting dry erase surfaces are disclosed in U.S. Pat. No. 5,207,581 (Boyd) and U.S. Pat. No. 6,251,500 (Varga & Baechle), and in U.S. Patent Application Nos. 2003/0008095 and 2004/0091849. Commercially available flexible dry erase surfaces include vinyl films, and ultraviolet radiation (UV) curable hardcoat films. Exemplary vinyl dry erase articles are sold by Best-Rite Manufacturing, Temple, Tex. Exemplary WV curable hardcoat film dry erase boards are commercially available from General Binding Corporation, Northbrook, Ill. and ACCO World Corporation, Lincolnshire, Ill.

It would therefore be desirable to provide an easily transportable dry erase surface that allows for a variety of writing surface areas without significantly altering the ease of transportation, and which preserves the written material on the dry erase surface during transport. It would also be desirable to provide a user friendly surface to the user that helps prevent the user from writing or erasing past the peripheral edge of the sheet onto the supporting surface. Further, it would be desirable to provide a mechanism for storing markers, erasers, and other items with the dry erase surface without substantially compromising its transportability.

BRIEF SUMMARY OF THE INVENTION

The invention is a display article having a flexible substrate which includes a writing surface capable of being used as a dry erase surface. A peripheral edge extends around the writing surface. A flexible framing strip is affixed to the writing surface at a position proximate to the peripheral edge. One embodiment of the display article can be made by forming a substrate having a writing surface. The substrate defines a peripheral edge, a back surface, and a plurality of mushroom shaped hooks extending from the back surface substantially over the entire back surface. The writing surface is capable of being used as a dry erase surface. At least a portion of the periphery of the writing substrate is folded over to form a framing strip having a plurality of exposed mushroom shaped hooks. The framing strip is secured to the writing surface.

BRIEF DESCRIPTION OF THE DRAWINGS

The present invention will be further explained with reference to the figures referenced below, wherein like structure is referred to by like numerals throughout the several views.

While the above-identified drawings set forth several embodiments, other embodiments of the present invention are also contemplated, as noted in the discussion. This disclosure presents illustrative embodiments of the present invention by the way of representation and not limitation. The drawings are not drawn to scale and are for illustrative purposes. Numerous other modifications and embodiments can be devised by those skilled in the art which fall within the spirit and scope of the principles of this invention.

DETAILED DESCRIPTION OF THE INVENTION

Figure 1:
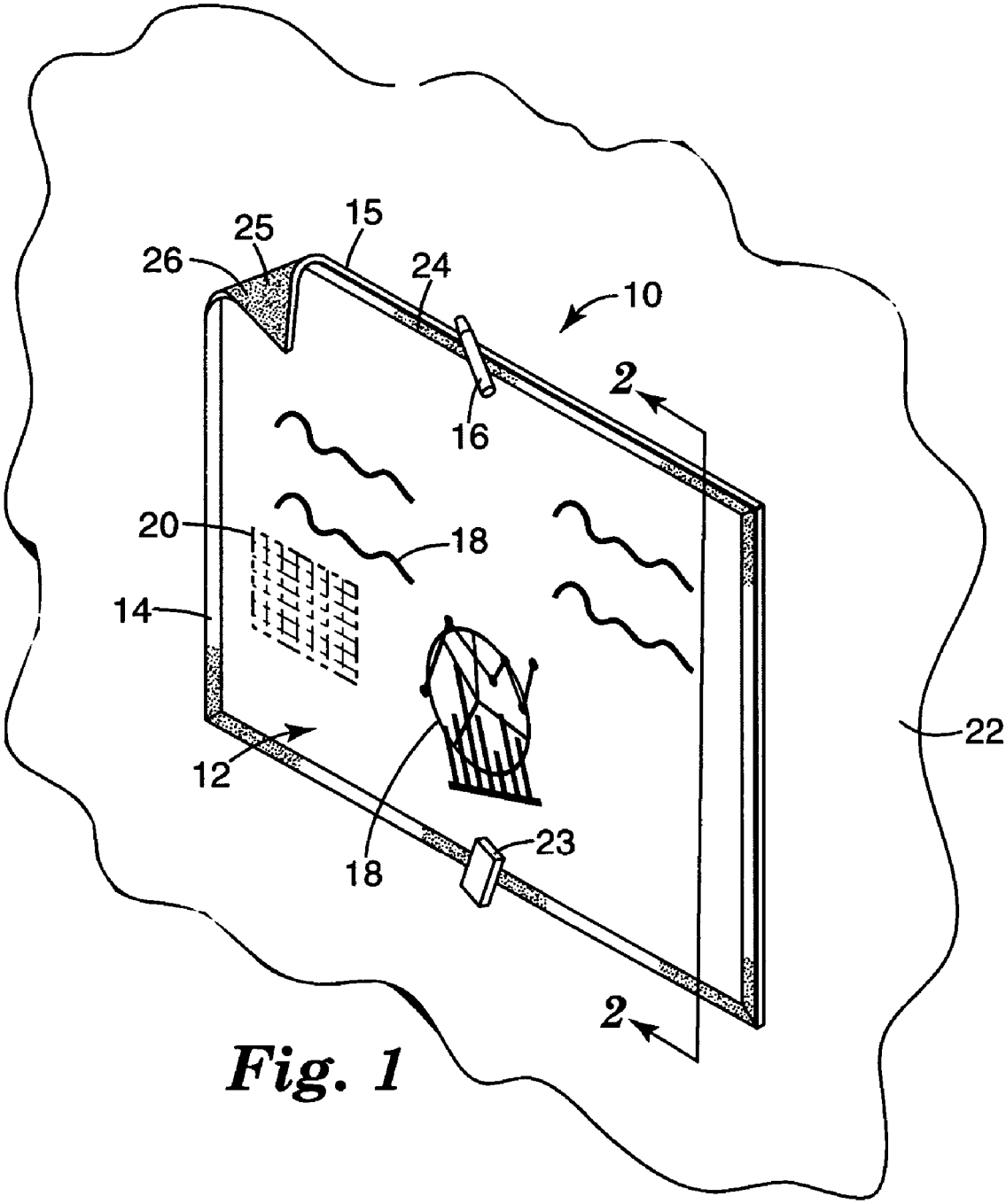
FIG. 1 is an isometric view of the inventive dry erase article.

One embodiment of the inventive dry erase article is illustrated at 10 in FIG. 1. Dry erase article 10 includes writing surface 12 that accepts ink from a writing implement such as a dry erase marker or permanent marker. Dry erase article 10 also includes a framing strip 14 disposed around peripheral edge 15 of writing surface 12. Typically, framing strip extends generally parallel to the peripheral edge 15. Framing strip 14 may completely surround writing surface 12 (as illustrated in FIG. 1) or alternatively may only extend around a portion of writing surface 12. Framing strip 14 may also be used to subdivide writing surface 12. Typically, dry erase markers 16 are used to write on writing surface 12, transferring ink to writing surface 12 in the form of written indicia 18. In one embodiment, dry erase article 10 may include printed indicia (or "pre-printed" indicia) 20 (shown in dotted lines) which cannot be erased. Examples of printed indicia 20 may include lines, graphics, calendars, and other indicia that may be useful. Dry erase article 10 is illustrated mounted to substantially flat vertical surface 22 (such as a wall) using mounting mechanism 25.

Acceptance of ink on writing surface 12 as written indicia 18 without beading of the ink can be defined as the "wettability" of the dry erase writing surface 12. Acceptable wettability (or writing without dewetting) is accomplished if the surface energy of the writing surface 12 is greater than the surface tension of the solvents in the marker inks. Writing surface 12 additionally provides a level of "erasability" which allows the user to wipe away (e.g. with a dry cloth or dry eraser) written indicia 18 once it is no longer desired. Acceptable erasability is achieved if the surface energy of the writing surface is sufficiently low to prevent tenacious adhesion of the binders and other solids in the marker inks to the writing surface. In one embodiment, the surface energy of the writing surface 12 is within the range of about 25 $mJ/m^2$ to about 40 $mJ/m^2$. In another embodiment, the surface energy of the writing surface 12 is within the range of about 30 $mJ/m^2$ to about 35 $mJ/m^2$, as measured by the Dyne Pen Test (described below). In the current inventive dry erase article 10, writing surface 12 is easily erasable with a simple felt eraser 23.

It is desirable for writing surface 12 to have a surface energy of greater than or equal to about 25 $mJ/m^2$. This surface energy of writing surface 12 prevents ink from typical dry erase and permanent markers from beading up on the writing surface 12. Written indicia is received as a continuous layer, preventing beading up or "gaps" in the lines forming written indicia. Typical marker solvents include ethanol, isopropanol, methyl isobutyl ketone, n-butyl acetate, ethyl acetate, n-propanol, and n-butanol. In order for the marker to completely wet out the dry erase surface without beading up, the surface energy of the dry erase surface must be greater than the surface tension of the solvents in the maker. The solvent in the list above with the highest surface tension is n-butyl acetate, with a surface tension of about 25 $mJ/m^2$. Therefore, in one embodiment, the writing surface of the dry erase article has a surface energy greater than or equal to about 25 $mJ/m^2$. In an alternate embodiment, the writing surface of the dry erase article has a surface energy greater than or equal to about 30 $mJ/m^2$ as measured by the Dyne Pen Test. Additionally, written indicia can preferably be quickly removed from dry erase article 10 with a minimum of wiping and a minimum of absorbance of ink (or "ghosting") by dry erase article 10. Acceptable removability of the ink is achieved if the surface energy of the writing surface is sufficiently low to prevent the binders and other solids in the marker inks from adhering tenaciously to the writing surface. Therefore, in one embodiment, the writing surface of the dry erase article has a surface energy less than or equal to about 40 $mJ/m^2$. In an alternate embodiment, the writing surface of the dry erase article has a surface energy less than or equal to about 35 $mJ/m^2$.

Figure 2:
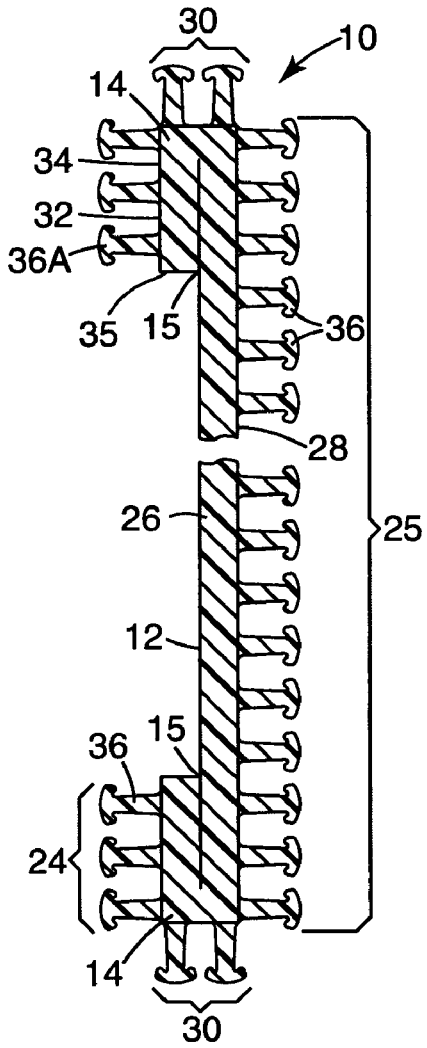
FIG. 2 is a partial cross-sectional view of one embodiment of the inventive dry erase article as taken along line 2-2 of FIG. 1.
Figure 3:
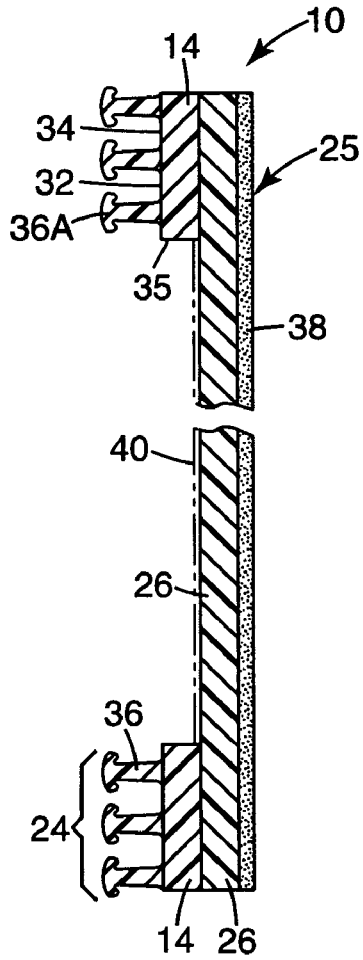
FIG. 3 is a partial cross-sectional view of an embodiment of the inventive dry erase article as taken along line 2-2 of FIG. 1.
Figure 3A:
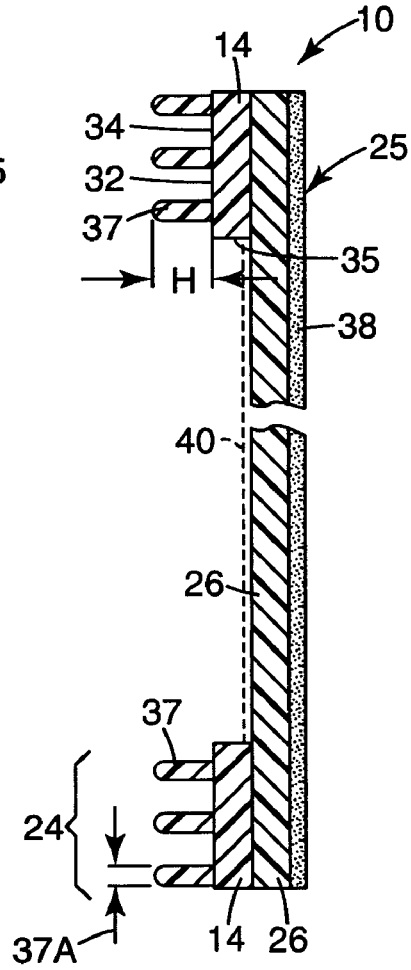
FIG. 3A is a partial cross-sectional view of another embodiment of the inventive dry erase article as taken along line 2-2 of FIG. 1.

In one embodiment, framing strip 14 includes an attachment mechanism 24 that is used to secure various items such as markers 16 and erasers 23. Additionally, certain embodiments of the invention include framing strip 24 that helps to prevent the user from marking beyond the writing surface 12, and onto the vertical surface 22. Framing strip 14 is secured to a flexible substrate 26 (for example, as shown in FIGS. 2, 3, and 3A), having an exposed major surface used as writing surface. Substrate 26 may preferably be formed of a low surface energy thermoplastic, e.g., polypropylene and blends thereof, polyethylene and blends thereof, polyesters and blends thereof, polyvinyl chloride and blends thereof, or Nylon. Other polymeric materials and blends may be used, as well as coated paper materials.

Framing strip 14 may consist of several different types of materials being adhesively attached to the writing surface 12 around peripheral edge 15. Framing strip 14 may be formed from a varety of materials. By way of non-limiting example, framing strip 14 can be formed from plastic materials such as but not limited to vinyl, polyolefins, polystyrene, polyester, and polyurethane. These plastic materials may be in the form of plastic adhesive backed tapes of varying thicknesses that are secured to writing surface 12 by applying the adhesive side of the tape against writing surface 12. Foam materials such as but not limited to polyethylene, vinyl, polyurethane, rubber, polyether and silicone open and closed cell foams may also be used to form framing strip 14. Examples of these types of foams are available in an adhesive backed tape form from 3M Company of St. Paul, Minn. (4516 Single Coated Vinyl Foam Tape, 4314 Single Coated Urethane Tape) and Kent Manufacturing Company of Grand Rapids, Mich. Non-woven materials can also be used to form framing strip 14. Exemplary non-woven materials include but are not limited to Dupont™ Tyvec™ spunbonded olefin materials available from E. I. du Pont de Nemours and Company, Wilmington, Del. and Micropore™ medical tape from 3M Company of Maplewood, Minn. Additionally, other materials such as cork, felt fabric, woven fabrics, and plastic coated fabrics may be used. One embodiment of inventive dry erase article 10 uses framing strip 14 incorporating male reclosable fastener materials (described in further detail with respect to FIGS. 2-3B, below).

Alternatively, writing surface 12 can be treated around the peripheral edge 15 to create a raised (e.g. by embossing) pattern to create a surface that is visually and tactilely differentiated from the rest of the writing surface.

Framing strip 14 material can be adhesively bonded to writing surface 12. Suitable adhesives for bonding the framing strip 14 to the writing surface 12 are pressure sensitive or hot melt adhesives. Framing strip 14 can be secured to writing surface 12 such as by thermal lamination, ultrasonic lamination, microwave lamination, or by application using a permanent adhesive (e.g., a pressure sensitive adhesive or a hot melt adhesive) or adhesive film such as Scotch™ Hi Strength Adhesive, Scotch™ 300LSE Hi Strength Adhesive, or 3M™ Command™ Adhesive (all available from 3M Company, St. Paul, Minn.), among other methods known to one skilled in the art.

Alternatively, framing strip 14 could be printed directly onto the writing surface 12. The printed framing strip would give the user a visual cue that the user is approaching the edge of the sheet with the marker or eraser. The printing inks could consist of solvent based, water based or monomer based UV curable inks commonly used for screen printing, flexographic printing or offset printing. Any one of these printing methods could be used for applying a printed type framing strip 14. The printing ink could also include an expanding agent such as but not limited to EXPANCEL® spherical plastic microspheres available from Akzo Nobel Company, The Netherlands. This expanding agent will raise the ink to a greater thickness (i.e. such as if an embossing technique had been used). In addition to a visual cue the raised ink also gives the user a tactile cue (as described previously) to help prevent the user from writing past the peripheral edge of the sheet onto the supporting surface which can damage or lessen the aesthetic quality of the underlying surface.

Framing strip 14 defines step 35 between writing surface 12 and outer surface of framing strip 14. Step 35 helps to prevent a user from "overwriting" or writing past the peripheral edge of writing surface 12. In one embodiment, step 35 defines a surface (or surfaces) between and generally normal to writing surface 12 and outer surface 34. As a user is writing or erasing on writing surface 12 and the writing or erasing instrument approaches peripheral edge 15, the writing or erasing instrument engages step 35. The resistance to further movement provides an indication to the user (in other words a tactile cue) that the edge of the writing surface has been reached and reduces the chances that the user will force the writing or erasing instrument past the framing strip 14. This function of the step greatly reduces the likelihood that the user will write or erase on the vertical surface to which the dry erase article has been mounted. In one embodiment, the distance between writing surface 12 and outer surface 32 is at least around 0.5 mm, or greater. The outer surface of framing strip 14 may further function to discourage the user from writing or erasing past the peripheral edge 15. If the outer surface of framing strip 14 is rough or textured, the texture will provide more resistance to the motion of the marker or eraser than that provided by writing surface 12, even if the marker or eraser passes over the step 35 and onto the outer surface of framing strip 14. This provides a further tactile cue to the user that the marker tip or eraser is approaching peripheral edge 15.

In preferred embodiments, the color of framing strip 14 differs significantly from that of writing surface 12, providing the user with an additional visual cue regarding the position of the peripheral edge of the writing surface. This can be accomplished, for example, by addition of pigments, dyes, or finely divided inorganic materials during the fabrication of framing strip 14 by well-known polymer processing methods. In some embodiments, writing surface 12 is substantially white or nearly white in color and the overall color difference, (referred to as $\Delta E^*$), between writing surface 12 and framing strip 14 is greater than or equal to 30, as measured by the Overall Color Difference Test (described below). In one exemplary embodiment, writing surface 12 is substantially white or nearly white in color and the overall color difference (or $\Delta E^*$) between writing surface 12 and framing strip 14 is greater than or equal to 55 as measured by the Overall Color Difference Test, providing a stark visual contrast between the writing surface 12 and framing strip 14.

The framing strip materials preferably provide a visual and tactile cue to the user that helps prevent the user from writing past the peripheral edge of the sheet onto the supporting surface. Framing strip 14 has the additional benefit of preventing "erased" ink removed from writing surface 12 from falling onto the surface supporting dry erase article 10. In the embodiments where framing strip 14 is raised in relation to writing surface 12, framing strip 14 acts to catch falling dried ink removed during the erasing process, protecting the substrate disposed below the mounted dry erase article 10.

FIG. 2 is a cross-sectional view of dry erase article 10 as taken along lines 2-2. As mentioned previously, substrate 26 includes writing surface 12 formed on one major surface. Back surface 28 forms the other major surface of substrate 26. Preferably, substrate 26 is flexible enough to allow the user to store dry erase article 10 in a roll configuration. In one embodiment, substrate 26 has a flexibility of at least 6.4 mm as measured by the Mandrel Bend Test (described below). Substrate 26 may be clear, translucent or opaque and may be colorless or colored (including white). Mounting mechanism 25 is disposed on back surface 28 of substrate 26. Framing strip 14 is disposed on opposing edges 30 of substrate 26 along peripheral edge 15 of writing surface 12. Framing strip includes inner surface 32 disposed against the surface of substrate forming writing surface 12 and outer surface 34, opposite inner surface 32. An outer surface 34 of framing strip 14 is exposed and supports attachment mechanism 24. Again, framing strip 14 is preferably flexible enough to allow user to store dry erase article 10 in a roll configuration. In one embodiment, framing strip 14 has a flexibility of at least 6.4 mm as measured by the Mandrel Bend Test.

In one embodiment, framing strip 14 is formed by folding a portion of substrate 26 onto itself. In other words, the opposing edges 30 of substrate 14 are folded such that a portion of the surface forming writing surface 12 becomes inner surface 32 of framing strip 14 and a portion of back surface 28 becomes outer surface 34 of framing strip 14.

Attachment mechanism 24 is disposed on outer surface of framing strip 14. In one embodiment, attachment mechanism 24 is formed from a plurality of mushroom shaped hooks 36, such as those hooks known as Scotch® Dual Lock Reclosable Fasteners, commercially available from 3M Company, St. Paul, Minn. Hooks 36 have a dual functionality of providing a texture to resist the motion of a marker across the framing strip 14 as described above, and providing a means to secure items (e.g., writing implements and erasers) on the framing strip 14 for storage.

Hooks 36 are typically of uniform height, although hooks 36 may vary in height, and may also be any desired height, cross section, or head shape. Exemplary heights of the hooks, measured from outer surface 34 to the bottom of head 36A of hook 36, are in the range of about 0.002 in to about 0.500 in. (about 0.005 cm to about 1.27 cm). Preferred heights of the hooks, measured from outer surface 34 to the bottom of head 36A are in the range of about 0.025 in. to about 0.075 in. (about 0.064 cm to about 0.191 cm).

Exemplary heights of heads portion 36A of hooks 36, measured from the bottom of head 36A to the top of head 36A, are in the range of about 0.002 to about 0.215 in. (about 0.005 to about 0.546 cm). Preferred heights of heads 36A of the hooks 36, measured from the bottom of head 36A to the top of head 36A, are in the range of about 0.010 in. to about 0.030 in. (about 0.025 cm to about 0.076 cm). Alternatively, as mentioned previously, the heights of the hooks 36 may vary on the outer surface 34.

Exemplary diameters of stem portion 36B of hooks 36 are in the range of 0.003 in. to 0.070 in. (about 0.008 cm to about 0.178 cm.) Most preferred diameters of the stems are in the range of 0.008 in. to 0.016 in. (about 0.020 cm to about 0.041 cm). Stems 36B may be cylindrical or tapered. Preferred diameters of heads 36A at their outermost periphery are in the range of about 0.005 in. to about 0.150 in. (about 0.013 cm to about 0.381 cm.). More preferred diameters of heads 36A at their outermost periphery are in the range of about 0.018 in. to about 0.030 in. (about 0.046 cm to about 0.076 cm.).

The head density of outer surface 34 is equal to the planar area occupied by heads 36 divided by the total area of the top surface of backing outer surface 34. The head density may be selected based on the desired use. Preferably, the head density is selected such that engagement between an array of hooks 36 and a mating loop or fabric material, or between a first array of hooks 36 and a second opposing array of hooks, can engage, yet there is a sufficient density so that strong engagement is achieved. The head density for outer surface 34 is preferably in the range of about 14 percent to about 45 percent. More preferably, the head density is in the range of about 30 percent to about 35 percent.

The number of hooks 36 in a given area may be any number, selected based on the size of the hooks 36 and head portions 36A engaging stems. One preferred density of engaging hooks is in the range of about 7 hooks/in$^2$ to about 22959 hooks/in$^2$ (1 hooks/cm$^2$ to 3560 hooks/cm$^2$). A more preferred density of hooks is in the range of about 285 hooks/in$^2$ to about 804 hooks/in$^2$ (44 hooks/cm$^2$ to 125 hooks/cm$^2$).

A preferred distribution of the hooks would include a plurality of engaging stems located in unordered arrangements, which repeat on a substrate, as described in U.S. Pat. No. 6,076,238 (Arsenault, et al.). A preferred embodiment of attachment mechanism 24 provides a plurality of repeating unordered arrangements of the mushroom shaped hooks, where the arrangements repeat in more than one direction. The unordered arrangements of the engaging hooks allow pairs of opposing hooks to engage. Additionally, the unordered arrangements of hooks allow opposing hooks to engage with a relatively constant engagement force, and a relatively constant disengagement force, regardless of the angular orientation of the opposing hook arrays with respect to one another.

The stiffness of the hooks is related to the diameter, height, and material of the hook. For hook stem portion 36B diameters in the range of about 0.012 in to about 0.016 in. (about 0.030 cm to about 0.041 cm) and stem 36B heights in the range of about 0.015 in to 0.051 in. (0.038 cm to 0.0130 cm.), the flexural Modulus is preferably in the range of about 25,000 psi to about 2,000,000 psi (172,250 kPa to 13,780,00 kPa). For stem 24 diameter of about 0.014 in (about 0.0356 cm) and a stem 24 height of about 0.037 in. (about 0.094 cm.) a more preferred flexural Modulus is approximately 200,000 psi (1,378,000 kPa).

Mushroom shaped hooks 36 provide a securing mechanism that engages and retains similar or identical mating hooks, cloth, non-woven material, or the loop material from hook and loop type fasteners, among others, which can be mounted on articles (e.g. markers and erasers), thereby securing the articles to the framing strip 14. Similarly, mounting mechanism 25, secured to back surface 28 of substrate 26 can also be formed of mushroom shaped hooks 36. In one embodiment, the detailed description of mushroom shaped hooks 36 for the attachment mechanism 24 similarly applies to the mushroom shaped hooks used for the mounting mechanism 25. The mushroom shaped hooks 36 forming mounting mechanism 25 allow the user to secure dry erase article 10 to cloth surfaces (such as a cubicle wall), similarly shaped mushroom shaped hooks secured to a vertical surface, non-woven material, or the loop portion of hook and loop fastening materials, among others.

In one embodiment, a single securing mechanism can be disposed substantially continuously across back surface 28 of substrate 26. By folding opposing edges 30 of substrate (as described above) to form framing strip 14, the securing mechanism is presented on outer surface 34 of framing strip 14 forms attachment mechanism 24 and the remainder of the securing mechanism is exposed on back surface 28 forming mounting mechanism 25. While mushroom shaped hooks are illustrated in FIG. 2 as forming mounting mechanism 25 and attachment mechanism 24, it should be noted that other securing mechanisms may be used without departing from the spirit and scope of the invention. For example, repositionable pressure sensitive adhesives, such as the type used on Post-it® Notes, commercially available from 3M Company, St. Paul, Minn., may be used as attachment mechanism 24 and/or mounting mechanism 25. Exemplary repositionable pressure sensitive adhesives comprising polymeric microspheres, are described in U.S. Pat. No. 5,571,617 (Cooprider, et al.) and U.S. Pat. No. 5,824,748 (Kesti, et al.). Other pressure sensitive adhesives can also be used. Other securing mechanisms known in the art, such as cut loop materials like those commercialized by Velcro USA Inc. (Manchester, N.H.) under the trade name Velcro®, profile extruded hooks like those available from 3M Company (St. Paul, Minn.), molded hooks or "J-hooks" like those commercialized by Velcro USA Inc. (Manchester, N.H.) under the brand name Ultramate™, printed hooks like those commercialized by The Procter & Gamble Company (Cincinnati, Ohio), or palm tree hooks like those described in U.S. Patent Application No. 2004/0091849 (Gallant, et al.), can also be used as attachment mechanism 24 and/or mounting mechanism 25.

FIG. 3 illustrates an alternate embodiment of the inventive dry erase article 10, where attachment mechanism 24 is different from mounting mechanism 25. In this embodiment, mounting mechanism 25 is a coating of adhesive 38. Adhesive 38 can extend completely across back surface 28, or may only be on discrete portions of back surface (such as in stripes or patches). Adhesive 38 can be applied to substrate 26 in any number of ways, including direct coating of the adhesive, coating of a solution containing the adhesive solids dispersed in a volatile solvent or a mixture of solvents, application of a pre-formed film of transfer adhesive, or adhesive or thermal lamination of a polymeric film having the adhesive 38 disposed one one side, among others. As discussed previously, exemplary adhesives include repositionable pressure sensitive adhesives comprising polymeric microspheres, like those described in U.S. Pat. No. 5,571,617 (Cooprider, et al.) and U.S. Pat. No. 5,824,748 (Kesti, et al.). Other pressure sensitive adhesives can also be used. These can be applied directly to back surface 28 of dry erase article such as by coating, or by attachment of a polymeric sheet or foam having a permanent adhesive (e.g., a pressure sensitive or hot melt adhesive) on one side and a repositionable adhesive in the other side. One example of such a sheet material is Scotch® 9415 differential adhesive sheet, available from 3M Company, St. Paul, Minn. In some applications, it is advantageous to provide the repositionable adhesive as the mounting mechanism 25 by means of a foam having a permanent adhesive one one side and a repositionable adhesive on the opposite side, as the greater conformability of the foam facilitates adhesion of the repositionable adhesive to a rough supporting surface (e.g., a textured wall). It is desirable that the adhesive provide sufficient adhesion to hold the dry erase article securely on a vertical substrate (e.g., a wall), while not providing too much adhesion such that the substrate is damaged upon removal of the dry erase article.

In lieu of integral hook fasteners or coated adhesive, other components may be used to secure dry erase article 10 to a vertical surface. For example, foam material having a permanent adhesive on one side and a repositionable adhesive on the other side (e.g., Scotch® Mounting Squares, available from 3M Company, St. Paul, Minn.) may be adhered to the back surface of the substrate 26 using the permanent adhesive side. The exposed repositionable adhesive on the foam material then provides for repositionable attachment of the dry erase article to a vertical surface. Alternatively, adhesive-backed male fastener materials (e.g., Command™ Removable Interlocking Fasteners, available from 3M Company, St. Paul, Minn.) may be adhered to back surface 28 of substrate 26, the exposed fastener material then providing a means of attaching the dry erase article to a vertical surface comprising a textile (e.g., an office partition wall).

Figure 3B:
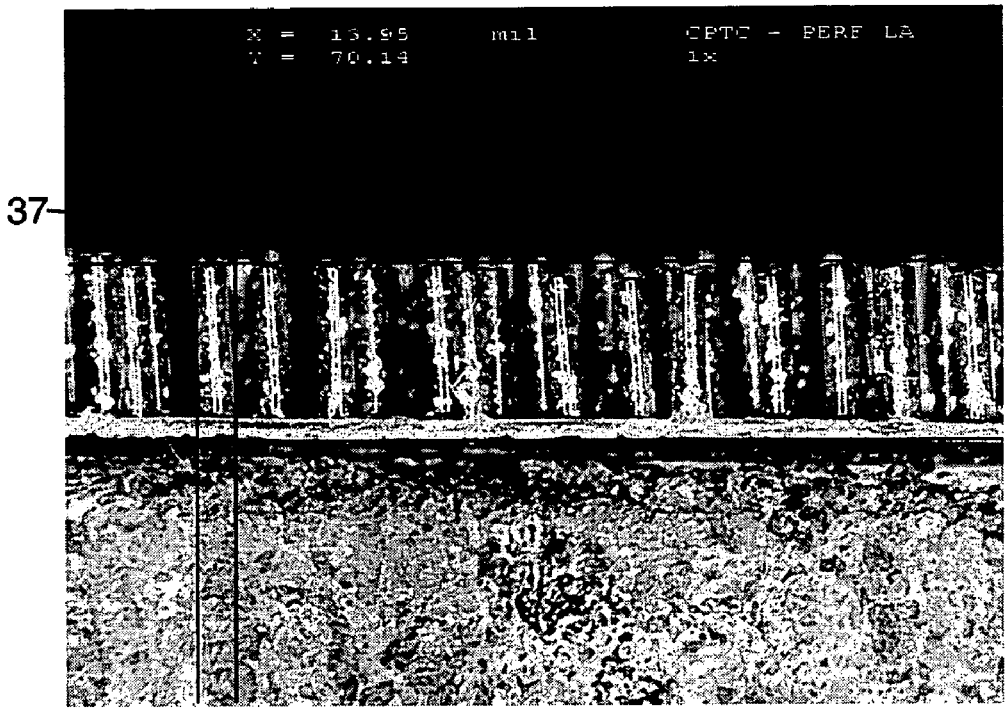
FIG. 3B is an optical micrograph of an embodiment of an attachment mechanism of the inventive dry erase article.

FIG. 3A illustrates an alternate embodiment of attachment mechanism 24 (and/or mounting mechanism 25) of dry erase article 10, where the attachment mechanism 24 (and/or mounting mechanism 25) utilizes columns 37 comprising an arrangement of unordered cylindrical stems of substantially uniform cross-section. The arrangement of columns 37 repeats on a substrate in an array similar to the use of mushroom shaped hooks 36 shown and described previously with respect to FIG. 2 and FIG. 3. FIG. 3B is an optical micrograph further illustrating exemplary columns 37 disposed on a substrate. Each column 37 in the array has a substantially constant cross-section 37A (i.e., having no cap, head or hook). In the illustrated embodiment, columns 37 are shown as part of framing strip 14 and framing strip 14 is a discrete material secured to substrate 26. While the illustrated embodiment has columns which are generally cylindrical, other cross-sectional shapes, including, but not limited to triangular and hexagonal are contemplated. Similarly, an ordered arrangement of columns having a definite pattern which repeats across the substrate is also contemplated.

Columns 37 are formed such that the array formed from columns 37 is self-engaging, i.e., the array of columns 37 can engage with an identical or similar opposing array of columns. The array of columns 37 includes an array of cylindrical stems, and further advantageously includes an array of cylindrical stems in an unordered array that repeats in more than one direction on framing strip 14 (or underlying substrate).

The functionality of such an array results from the surprising discovery that an array of columns having sufficient length and density will inter-engage with a similar opposing array of columns, providing a significant disengagement force in spite of the absence of the caps and hooks that resist the disengagement of conventional inter-engaging fasteners, including Velcro® type fasteners and mushroom type hook fasteners. In the case of straight columns, versus for example mushroom shaped hooks, the resistance to disengagement is provided entirely by the frictional force opposing the motion of contacting columns in the mated arrays against one another. Upon engagement, many of the columns or stems are bent against one another, thus providing a normal force against one another that results in a frictional force during disengagement. In order to provide adequately strong engagement, the constant cross-section columns of these fastener materials must be sufficiently dense that a large number are bent against one another upon engagement, and sufficiently high to generate a significant frictional force upon disengagement.

Columns 37 are typically of uniform height, although columns 37 may vary in height (indicated by the letter H in FIG. 3A). Preferred heights of the columns 37, measured from outer surface 34, are in the range of about 0.040 in to about 0.500 in. (about 0.102 cm to about 1.27 cm). Exemplary density of the columns 37 is in the range of about 500 columns/in$^2$ to about 1000 columns/in$^2$ (78 columns/cm$^2$ to 155 columns/cm$^2$). Exemplary diameters of columns 37 are in the range of 0.003 in. to 0.070 in. (about 0.008 cm to about 0.178 cm). Some preferred diameters of the columns 37 are in the range of 0.008 in. to 0.016 in. (about 0.020 cm to about 0.041 cm).

One exemplary distribution of the columns 37 would include a plurality of columns 37 located in unordered arrangements, which repeat across the substrate (illustrated as fastening strip 14 in FIG. 3A). One embodiment of attachment mechanism 24 provides a plurality of repeating unordered arrangements of columns 37 having constant cylindrical cross-section 37A, where the arrangements repeat in more than one direction. The unordered arrangements of the columns 37 increase the probability that, when the attachment mechanism 24 or mounting mechanism 25 is engaged with a like opposing material, many columns 37 on the opposing surfaces will be bent against one another during engagement, regardless of the angular orientation of the opposing fasteners with respect to each other.

Fastening systems comprised of arrays of columns 37 engage strongly enough to hold light items, such as dry erase markers 16, erasers 23 or other like items, on a vertical surface (see Example 3). Moreover, these "hookless" or "capless" columns 37 will not "snag on," or unintentionally engage with, knitted clothing that might be worn by the user (e.g., sweaters) and common household textiles, including carpets. This is of great utility with respect to the current invention, as the user of the dry erase sheet product may be wearing knitted clothing, the sleeves and other portions of which may frequently come in contact with framing strip 14.

In embodiments of the invention where repositionable adhesive is used as mounting mechanism 25, it is important that the force required to disengage an item (e.g., a dry erase marker) attached to the framing strip 14 is not greater than the force required to remove the mounting mechanism 25 from the underlying surface, as this may cause unintentional removal of the dry erase article 10 from the underlying surface during an attempt to remove the fastened item from the framing strip 14. The "hookless" or "capless" columns 37 described above have an advantage in this respect over many conventional fastener systems, the disengagement forces of which are too high relative to the force required to remove repositionable adhesives from common wall surfaces. By contrast, the disengagement forces of "hookless" or "capless" columns 37 described above are high enough to hold light items, like markers and erasers and the like, but low relative to the force required to separate many repositionable adhesives from common wall surfaces (see Example 3, below). Additionally, the "hookless" or "capless" columns 37 described above disengage more quietly than many conventional self-engaging or hook-and-loop type fasteners, which is an advantage particularly in an office environment. The above described self-engaging fastener materials comprising columns of substantially constant cross section are advantageous as the framing component of the dry erase article of this invention. Column style fasteners also have great utility in similar applications where it is desired to store light-weight items on a vertical surface. They are particularly useful in any application where it is desired to provide a fastener material for storing such items on a vertical surface (e.g., a wall) wherein the fastener material is attached to the vertical surface repositionably by means of a repositionable pressure sensitive adhesive. In such applications, the self-engaging fastener materials comprising columns of substantially constant cross section have the advantage over conventional self-engaging fasteners and hook-and-loop type fasteners that removal of items attached to the fastener will not result in removal of the repositionable adhesive on the opposite side from the vertical surface. This advantage is due to the low disengagement force of the self-engaging fastener materials comprising columns of substantially constant cross section.

An optional first layer 40, shown, for example, in FIGS. 3 and 3A, where it is indicated by dashed lines, may be disposed on substrate 26 and included as part of writing surface 12. First layer 40, may be included with dry erase article 10 to increase the writability and/or erasability of the dry erase article 10 as may be desired. This first layer 40 may be applied by direct coating of a curable composition, coating of a composition comprising solids which may be curable dispersed in a volatile solvent or a mixture of solvents, or lamination (adhesive, thermal, or otherwise) of an additional film. The first layer 40 may include a low surface energy hardcoat layer such as Gafgard® 300 available from International Specialty Products Inc., Wayne, N.J., or RAD-KOTE 860DEF available from RAD-CURE Corporation, Fairfield, N.J., or an additional layer of film, such as a polymeric film having a low surface energy hardcoat layer on one side and a thermal or pressure sensitive adhesive on the opposite side to facilitate lamination (e.g., dry erase laminating film, product no. X015420 available from Protect-all, Inc., Darien, Wis.). First layer 40 preferably does not substantially affect the flexibility of the overall dry erase article 10 so as to continue to allow the article to be easily rolled up and transported.

It should be noted that other embodiments of the inventive dry erase article may also include optional additional layers. For example, one or more primer layers may be used to facilitate adhesion of one or both of the first layer 40 or the adhesive 38 to the substrate. Additionally, pre-printed indicia (also described with respect to FIG. 1) may also be included, either in a layer between substrate and first layer or on the back surface of substrate if substrate is transparent or translucent.

Figure 4:
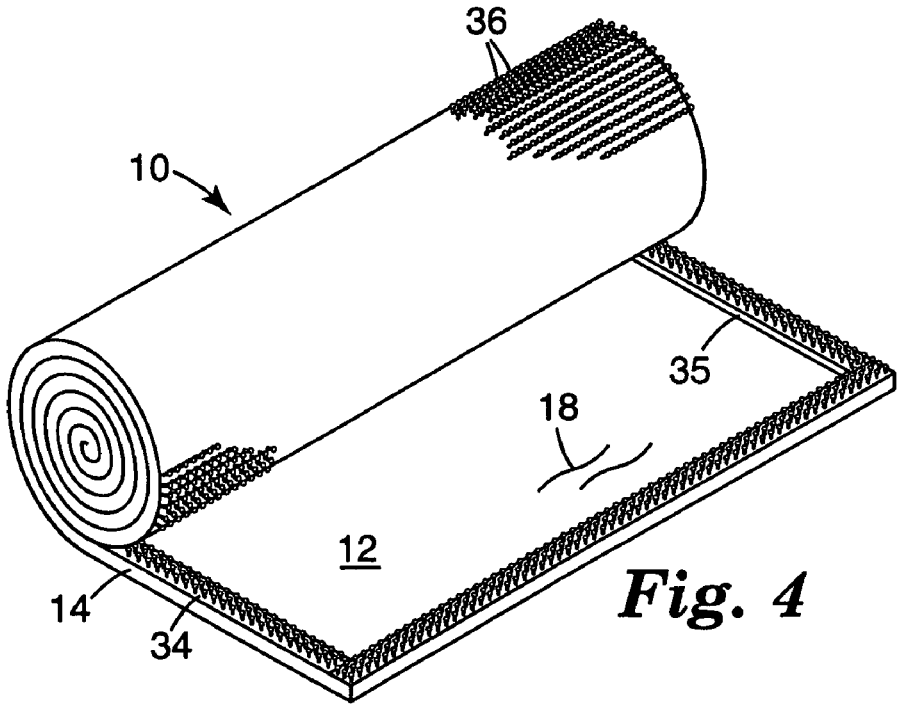
FIG. 4 is an isometric view of an embodiment of the inventive dry erase article in a roll.

The embodiment of dry erase article 10 of FIG. 1 is illustrated in a rolled up configuration in FIG. 4. The flexibility of a film or a coated film can be measured by the Mandrel Bend Test described in more detail in the example section. A flexible substrate can be bent 180 degrees around a 6.4 mm diameter mandrel without showing any visible signs of cracking or fracture. More preferably, the flexible coated substrate can be bent 180 degrees around a 4.8 mm mandrel without any change an appearance. This flexibility allows the article to be easily transported and stored, since the article can be rolled or otherwise applied without harm to the dry erase article 10. FIG. 4 also illustrates an additional use of the framing strip 14 of this invention comprising an attachment mechanism. If the attachment mechanism 24 of the framing strip 14 can engage with the mounting mechanism 25, then the attachment mechanism 24 and the mounting mechanism 25 serve to anchor the dry erase article 10 in a rolled up configuration during transport and storage. The dry erase article 10 can then be reversibly unrolled by disengagement of the attachment mechanism 24 and mounting mechanism 25. This utility is realized, for example, if the attachment mechanism 24 and the mounting mechanism 25 are both self-engaging male fastener materials, or alternatively if one is a male fastener material and the other is a mating loop fastener or other fabric material.

TEST METHODS AND EXAMPLES

Dyne Pen Test for Surface Energy

Dyne pens or surface energy pens are available from UV Process Supply, Inc., Chicago, Ill. The pens come in a set of 8 ranging in surface tension from 30 $mJ/m^2$ to 44 $mJ/m^2$ in steps of 2 $mJ/m^2$. The 30 $mJ/m^2$ pen is first applied to the dry erase surface in a continuous line about 5 cm long. Subsequently, the next higher surface tension pen is applied to the surface. The writing line of the pen is observed for one minute. The surface energy of the surface was taken as the surface tension of the highest number pen that did not dewet in one minute. (Dewetting of ink is indicated by the ink visibly "beading up," or forming visible droplets, on the surface.)

Mandrel Bend Test for Flexibility

The mandrel bend test is adapted from ASTM D3111, "Standard Test Method for Flexibility Determination of Hot-Melt Adhesives by Mandrel Bend Test Method." Test specimens are cut into sheets of about 20 by 25 mm. Smaller specimens can also be tested. Each sheet is wrapped 180 degrees around a metal rod or mandrel within 1 second. If the specimen is coated, the coated side of the specimen is on the outside of the mandrel. The mandrel diameters used for this test are 6.4 mm (¼ in), 4.8 mm (3⁄16 in), and 3.2 mm (⅛ in). The specimen is then removed from the mandrel and examined with a 4× eyepiece or a microscope. Failure of the mandrel bend test was evidenced by the appearance of visible fracture, crazing, or cracking of the coating or the substrate or debonding of any coating from the substrate.

Overall Color Difference Test

The Overall Color Difference Test is adapted from the Technical Association of the Pulp and Paper Industry (TAPPI) Test Method T 524, "Color of paper and paperboard (45/0, C/2)." A spectrophotometer is used to illuminate the surface of a sample material using a standard light source, International Commission on Illumination (CIE) illuminant C. The reflected light is collected at an observer angle of 10 degrees from the incident light and mathematically characterized in terms of three CIE standard measurement parameters: L*, representing lightness increasing from zero for black to 100 for perfect white; a* representing redness when positive and greenness when negative; and b* representing yellowness when positive and blueness when negative. Spectrophotometers capable of performing CIE measurements are commercially available (e.g., GretagMacbeth™ Spectro-Eye™ spectrophotometer, available from GretagMacbeth, Regensdorf, Switzerland). When two surfaces are characterized in this way, the symbols ΔL*, Δa*, and Δb* represent the differences between the values of L*, a*, and b* for the two surfaces. The overall color difference ΔE* is given by, $$\Delta E^*=(\Delta L^{*2}+\Delta a^{*2}+\Delta b^{*2})^{1/2}.$$

The overall color difference ΔE* takes into account lightness/darkness differences as well as chromatic differences between the two surfaces, and is intended to represent the same visual perception of color difference anywhere in color space.

Marker Drag Force Test for Write-Off Resistance

The marker drag force test is adapted from the Technical Association of the Pulp and Paper Industry (TAPPI) Test Method T 549, "Coefficients of static and kinetic friction of uncoated writing and printing paper by use of the horizontal plane method." A horizontal plane is mounted on the lower grip fixture of a vertical tensile tester (Instron® 1122, available from Instron®, Canton, Mass.). The horizontal plane is a 15.24 cm (6 in) wide by 50.80 cm (20 in) long by 0.95 cm (⅜ in) thick aluminum plate, and is mounted in the tensile tester with the longest dimension of the horizontal plane directed horizontally outward from the front side of the tensile tester. An aluminum sled is provided, having dimensions of 6.35 cm (2.5 in) wide by 6.35 cm (2.5 in) long by 0.64 cm (¼ in) thick. A corner of one of the broad surfaces of the sled has (x,y) coordinates (0,0). Three threaded holes having a diameter of 0.64 cm (0.25 in) are drilled through the broad surface of the sled with the centers of the holes at coordinates (3.18 cm, 1.27 cm), (1.27 cm, 5.08 cm), and (5.08 cm, 5.08 cm). A dry erase marker (Dri Mark® 313B black, bullet tip, available from Dri Mark® Products, Inc., Port Washington, N.Y.) is screwed into each of the three threaded holes in the sled, such that the writing tip of the marker projects through the hole to the opposite side of the sled. The mass of the assembly formed by the sled and the three markers is 213 g. The sled is placed on the horizontal plane such that it rests on the three marker tips with the dry erase marker screwed into the hole at coordinates (3.18 cm, 1.27 cm) nearest the front of the tensile tester (furthest from the operator). A copper cable having a diameter of 0.52 mm is attached to the small surface of the sled furthest from the operator and nearest the dry erase marker at coordinates (3.18 cm, 1.27 cm). The opposite end of the copper cable is attached to the upper grip fixture of the tensile tester. A 3.81 cm (1.5 in) diameter pulley is attached to the horizontal plane such that, when the copper cable is positioned around the pulley, the copper cable extends from the end of the sled furthest from the operator, horizontally in the direction parallel to the top surface of the horizontal plane to the pulley, makes a 90 degree angle around the pulley, and extends vertically upward from the pulley to the upper grip fixture of the tensile tester.

A sheet of a substrate material (e.g., a dry erasable sheet) measuring approximately 15.24 cm (6 in) wide by at least 22.86 cm (9 in) long is placed on the horizontal plane with one edge against the edge of the horizontal plane nearest the operator. The sled is placed on top of the substrate with the markers against the substrate near the operator end of the horizontal plane, such that the copper cable extending around the pulley is taut. A piece of framing material having a width not more than 5.08 cm (2 in) is placed across the substrate perpendicularly to the copper cable and at a position between the sled and the front of the tensile tester. The test is then started, whereupon the sled is pulled at a rate of 0.254 cm/s (6 in/min) toward the framing material, engages the edge of the framing material, and is pulled completely across the framing material.

The output of the test is a plot of pulling force vs. position, in which there are four primary regions: (1) the region in which the single leading marker tip has not yet engaged the edge of the framing material, (2) the region in which the leading marker tip engages the vertical "step" formed by the front edge of the framing material and is pulled up and over the step, (3) the region in which the leading marker tip moves across the top surface of the framing material while the other two marker tips have not engaged the front edge of the framing material and continue to move across the substrate, and (4) the region in which the leading marker tip drops off the opposite edge of the framing strip and all three marker tips resume moving across the substrate. In region (1), the measured force $F_{f,substrate}$ is the force required to overcome the frictional force opposing the motion of the three marker tips across the substrate. In region (2), the maximum force measured is the barrier force, $F_B$ required to overcome the resistance of the vertical step formed by the edge of the framing strip. In region (3), the measured force $F_{f,frame}$ is the force required to overcome the frictional force opposing the motion of the two marker tips on the substrate, plus the force required to overcome the resistance to forward motion of the leading marker across the top surface of the framing material. If the substrate is smooth and the top surface of the framing material is rough or textured, then generally $F_{f,frame}>F_{f,substrate}$.

EXAMPLES

Example 1

Fabrication of a Decorative, Snag Resistant, Self-Engaging Fastener Material A mixture was formed comprising 76.6% by weight of a polypropylene copolymer (Marlex HGZ-180, available from Phillips Sumika Polypropylene Company, The Woodlands, Tex.), 19.2% by weight of an impact modifying polypropylene resin (Adflex KS359P, available from Montell Polyolefins, Wilmington, Del.), 0.2% by weight of a blue colorant (IRGALITE® Blue GLG available from Ciba Specialty Chemicals, Tarrytown, N.Y.), and 4.0% of a fmely divided reflective material (used as a decorative agent). The resin mixture was melted and conveyed with a single screw extruder (Davis Standard, Somerville, N.J.). The extruder had a diameter of 6.35 cm (2.5 in), a length:diameter ratio (L/D) of 24/1, and a rising temperature profile ranging from 199° C. (390° F.) in the first zone after introduction to 218° C. (425° F.) in the final downstream zone. The polymer was passed through the extruder and continuously discharged at a pressure of at least 6895 kPa (1000 psi) through a neck tube held at a temperature of 218° C. (425° F.) and into a 35.56 cm (14 in) wide EBR Deckle Film Die (available from Extrusion Dies Incorporated, Chippewa Falls, Wis.) with a temperature of 218° C. (425° F.) and a nominal die lip gap of 508 μm (0.020 in).

The melted polymer film was nipped between a chilled, 45.72 cm (18 in) wide steel cast roll and steel tool roll, having an array of mold cavities on the surface thereof in the form of elongated holes, to produce substantially cylindrical stems disposed across one side of a flat sheet formed of polymer in excess of that required to fill the mold cavities on the tool roll.

The mold cavities on the tool roll had a density of 109 holes/$cm^2$ (705 holes/$in^2$) and were arranged in a repeating, unordered fashion as described in U.S. Pat. No. 6,076,238 (Arsenault, et al.), resulting in a like arrangement of stems on the product. The final product was dark blue in color and comprised a smooth base sheet with a thickness of approximately 203 μm (8 mils), on one side of which were disposed an array of roughly cylindrical stems with a diameter of approximately 356 μm (14 mils) and a height of approximately 1575 μm (62 mils). The fastener material passed the 3.2 mm mandrel bend test for flexibility.

Example 2

Disengagement of Various Fastener Materials from Knitted Clothing

Figure 5A:
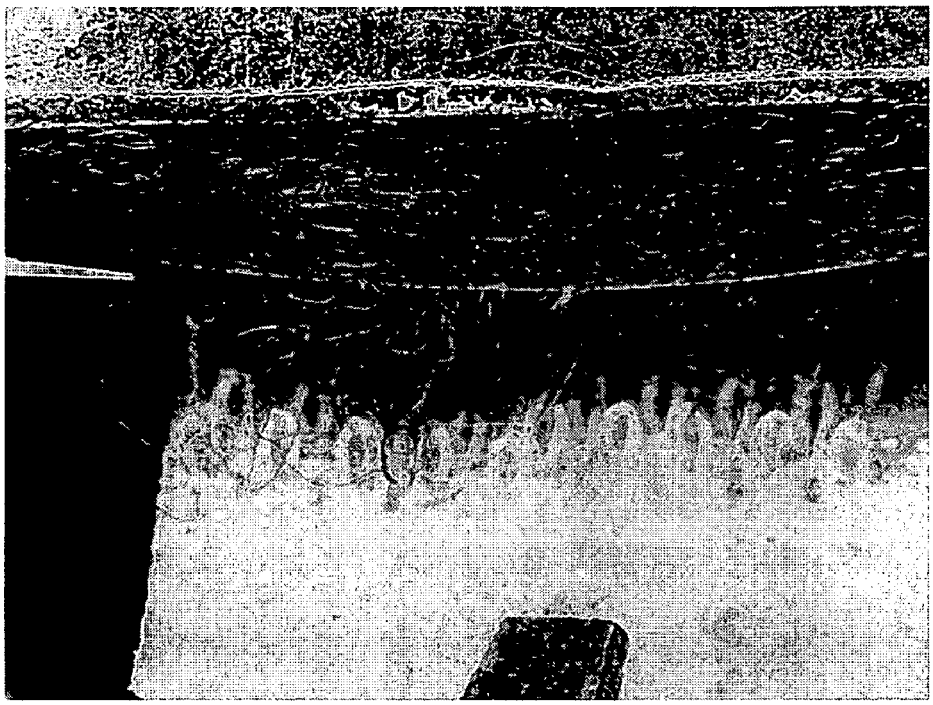
FIG. 5A is an optical micrograph of an embodiment of an attachment mechanism during disengagement from a knitted sweater.
Figure 5B:
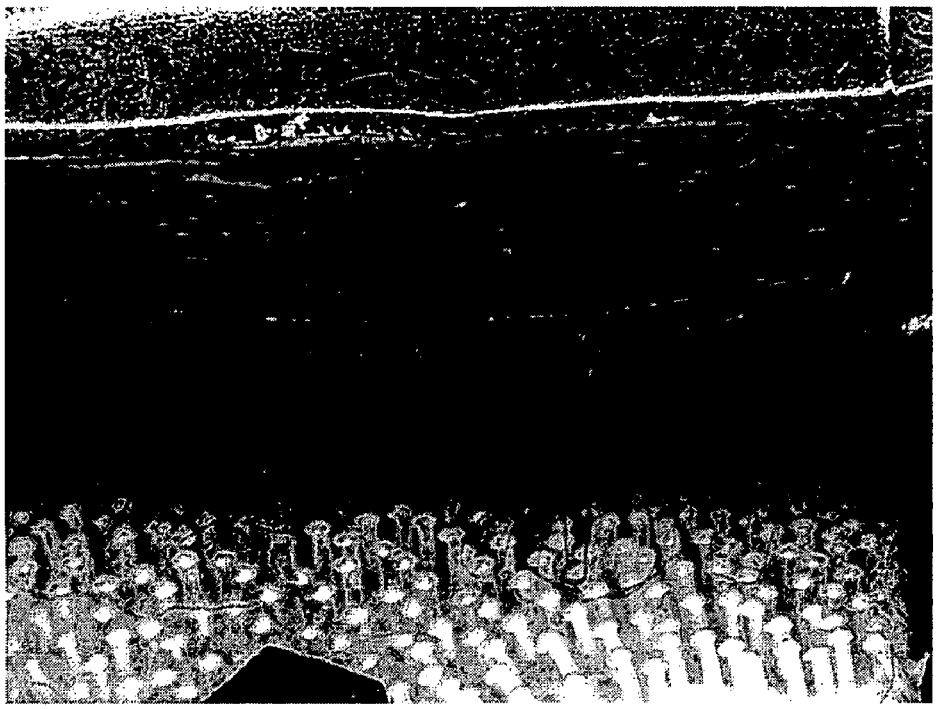
FIG. 5B is an optical micrograph of another embodiment of an attachment mechanism during disengagement from a knitted sweater.
Figure 5C:
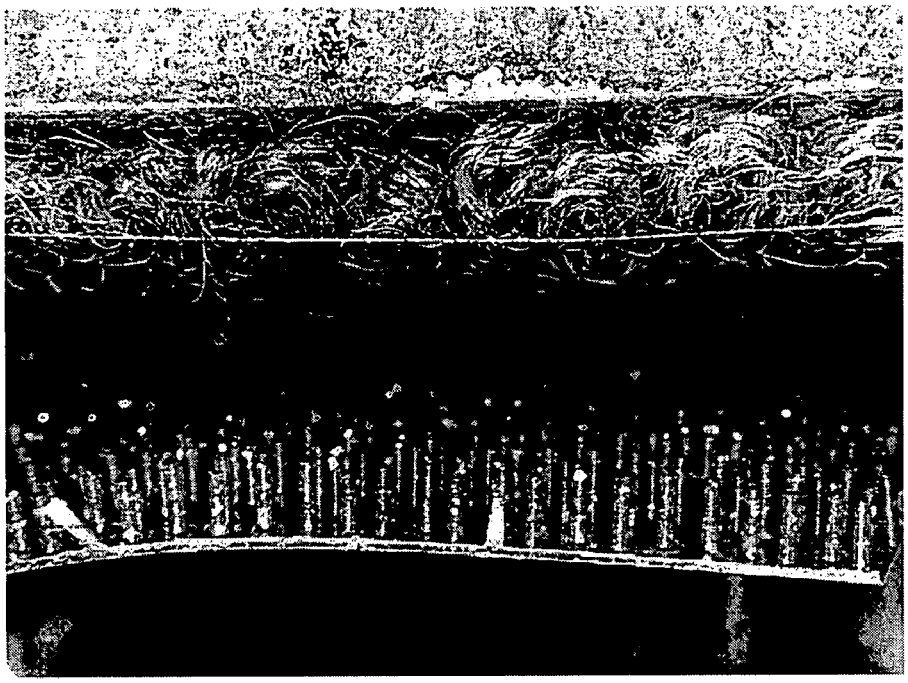
FIG. 5C is an optical micrograph of another embodiment of an attachment mechanism during disengagement from a knitted sweater.

Pieces of fabric were cut from a knitted sweater (50% acrylic, 50% wool, Laura Scott Petite, Item # 33372, available from J. C. Penney Corporation, Inc., Plano, Tex.). A piece of male fastener material was placed on the outward facing side of each piece of fabric with the engagement surface of the fastener material against the fabric, and the two pieces were pressed together firmly. They were then placed together under an optical microscope, and micrographs were taken as the male fastener materials were separated from the knitted fabric material using tweezers. FIG. 5A is a micrograph image showing 3M™ Scotchmate™ fastener, male, cut loop type (available from 3M Company, St. Paul, Minn.). Threads of fabric are engaged strongly by this fastener system, and are clearly seen being pulled from the fabric during disengagement. FIG. 5B is a micrograph image showing Velcro® Industrial Strength Reclosable Fastener, male, molded hook type (available from Velcro USA Inc., Manchester, N.H.). Again, threads of fabric are engaged strongly by this fastener system, and are clearly seen being pulled from the fabric during disengagement. FIG. 5C is a micrograph image showing the snag-resistant fastener material of Example 1 (the column type stems discussed with respect to FIG. 3A and FIG. 3B). No fabric is observed being engaged with or pulled by the uniform cross-section stems of this fastener material.

Example 3

Disengagement Force Required to Remove Various Fastener Materials from Carpet and Knitted Clothing The disengagement forces required to separate a number of male fastener materials from various fabrics were measured. The fabrics were samples cut from knitted clothing (sweaters), as well as household carpeting. The sample numbers and descriptions of the fastener materials and the fabric samples are listed in Table 1.

TABLE 1

Sample Numbers and Descriptions of Male Fastener and Fabric Materials

| Sample | Description |
|---|---|
| 3.1 | Velcro ® Industrial Strength Reclosable Fastener, molded hook type, available from Velcro USA Inc., Manchester, NH |
| 3.2 | 3M ™ Scotchmate ™ Hook and Loop Fastener, male portion, cut loop type, available from 3M Company, St. Paul, MN |
| 3.3 | 3M ™ Command ™ Removable Interlocking Fasteners, available from 3M Company, St. Paul, MN |
| 3.4 | Scotch ® Reclosable Fastener, available from 3M Company, St. Paul, MN |

TABLE 1-continued

Sample Numbers and Descriptions of Male Fastener and Fabric Materials

| Sample | Description |
|---|---|
| 3.5 | Snag-resistant fastener of Example 1 |
| 3.A | Knitted sweater; 50% acrylic, 50% wool; Laura Scott Petite, Item #33372, available from J.C. Penney Corporation, Inc., Plano, TX |
| 3.B | Knitted sweater; 75% acrylic, 12% cotton, 7% wool, 6% nylon; Croft & Barrow ® Petite, RN 73277, available from Kohl's Corporation, Menomonee Falls, WI |
| 3.C | Residential carpet, coarse Berber loop-pile type, 87% olefin/13% nylon, Style "Visionary," RN39127 1002/92907, available from Mohawk Industries, Inc., Calhoun, GA |
| 3.D | Residential carpet, fine Berber loop-pile type, 100% nylon, Style "Opulent," NFA-OPULEN-3, available from Mohawk Industries, Inc., Calhoun, GA |

Samples were cut into 2.54-cm (1-in) by 2.54-cm (1-in) square pieces and mounted onto plastic sample holders with a permanent adhesive. They were then pressed together with compression force of 178 N (40 lbs) using a force gauge (Chatillon® DFM 100 available from John Chatillon & Sons, Inc., New York, N.Y.) and test stand (Chatillon®). Next, the mated samples were mounted in a tension test stand (Chatillon® Model UTSM) and pulled apart at a constant separation rate of 25.4 cm/min (10 in/min), whereupon the maximum tension force between them (called the disengagement force) was measured using a force gauge (Chatillon® DFGS100).

Three of the male fastener materials tested, including the snag-resistant fastener material of Example 1, were self-engaging fasteners, capable of engaging with opposing identical materials. In a first set of experiments, the self-disengagement force of these fastener materials was measured. The averages for a number of disengagement trials for each, along with the standard deviations, are reported in Table 2. The snag-resistant fastener material of Example 1 (Sample 3.5) has a substantially lower disengagement force than conventional self-mating fastener materials. However, the disengagement force of this material is measurable and sufficient to hold the weight of objects weighing less than about 1 lb (4.4 N), including dry erase markers, erasers, and similar items.

TABLE 2

Self-Disengagement Force of Various Male Fastener Materials

| Sample | Disengagement Force (N) |
|---|---|
| 3.3 | 23.0 ± 1.0 |
| 3.4 | 222.7 ± 18.7 |
| 3.5 | 4.7 ± 1.0 |

The disengagement forces required to separate the male fastener materials from the test fabrics are shown in Table 3. With the exception of Sample 3.4, all of the conventional male fastener materials exhibited higher disengagement forces from all four of the fabrics than did the snag-resistant fastener material of Example 1 (Sample 3.5). Sample 3.4 exhibited removal forces similar to the fastener of Example 1 for the two knitted clothing fabrics, but significantly higher disengagement forces for the two carpet fabrics.

TABLE 3

| | | Disengagement Force of Various Male Fastener/Fabric Sample Pairs | | | |
|---|---|---|---|---|---|
| | | Fabric Material | | | |
| | | 3.A | 3.B | 3.C | 3.D |
| Male Fastener Material | 3.1 | 6.3 ± 3.0 | 6.2 ± 2.5 | 43.3 ± 9.4 | 60.0 ± 6.3 |
| | 3.2 | 8.8 ± 1.4 | 7.7 ± 2.4 | 27.9 ± 8.5 | 27.8 ± 6.9 |
| | 3.3 | 4.4 ± 2.6 | 3.6 ± 2.9 | 11.8 ± 4.1 | 11.3 ± 5.0 |
| | 3.4 | 1.7 ± 0.2 | 1.2 ± 0.8 | 7.5 ± 3.9 | 11.6 ± 0.0 |
| | 3.5 | 2.7 ± 0.3 | 1.4 ± 0.8 | 2.4 ± 0.0 | 4.2 ± 2.0 |

This example demonstrates the effectiveness of the inventive fastener material, comprising a repeating unordered arrangement of cylindrical stems having a constant cross-section, in providing a low-disengagement, self-engaging fastener material that resists unintentional engagement with fabrics, including knitted clothing and household carpeting.

Example 4

Fabrication of a Dry Erase Sheet Having an Integral Frame Comprising a Fastener Material A flexible backing sheet having one smooth surface and an opposing surface covered with mushroom type hooks was prepared roughly following the procedure detailed in U.S. Pat. No. 5,845,375 (Miller, et al.). A mixture was formed comprising 90% by weight of a melt processible polypropylene impact copolymer resin (SRD7-587 available from The Dow Chemical Company, Midland, Mich.) and 10% by weight of a melt processible polypropylene resin containing 50% by weight titanium dioxide (Product No. 1015100S available from Clariant GmbH, Muttenz, Switzerland). The resin mixture was melted and conveyed with a single screw extruder (Davis Standard, Somerville, N.J.). The extruder had a diameter of 6.35 cm (2.5 in), a length:diameter ratio (L/D) of 30/1, and a rising temperature profile ranging from 177° C. (350° F.) in the first zone after introduction to 204° C. (400° F.) in the final downstream zone. The polymer was passed through the extruder and continuously discharged at a pressure of at least 6895 kPa (1000 psi) through a neck tube held at a temperature of 204° C. (400° F.) and into a 35.56 cm (14 in) wide EBR Deckle Film Die (available from Extrusion Dies Incorporated, Chippewa Falls, Wis.) with a temperature of 204° C. (400° F.) and a nominal die lip gap of 508 μm (0.020 in).

The melted polymer film was nipped between a chilled, 45.72 cm (18 in) wide steel cast roll and a laser drilled (47 holes per $cm^2$, or 300 holes per $in^2$, prepared by Laser Machining Inc, Somerset, Wis.) silicone belt to produce substantially cylindrical "stems" disposed across one side of a flat sheet formed of polymer in excess of that required to fill the holes in the silicone belt. The resulting film was then run through a nip between two calendar rolls. The calendar roll that contacted the ends of the stems was maintained at a temperature of 149° C. (300° F.), while the opposing calendar roll was maintained at a temperature of 21° C. (70° F.). The calendar rolls were gapped such that the ends of the stems were flattened to form mushroom type hooks.

The resulting flexible backing sheet comprised a flat, smooth 250-μm (0.010-inch) thick base sheet with 760-μm (0.030-inch) tall mushroom shaped hooks disposed across the entirety of one side. The hook density was approximately 47 per $cm^2$ (300 per $in^2$). The flexible backing sheet was slit to a width of 22.86 cm (9 inches) and wound onto a 7.62-cm (3-inch) diameter core.

Three 22.86-cm (9-inch) wide by 152.4-cm (60-inch) long strips of the flexible backing sheet of Example 1 were placed side-by-side on a tabletop with the smooth surface of each strip facing up. The three strips were then butted together at their long edges and joined together by application of Scotch™ tape applied along the butted edges on the smooth side of the strips. This yielded a 68.58-cm (27-inch) wide by 152.4-cm (60-inch) long flexible backing sheet having two taped seams running lengthwise.

A pressure sensitive transfer adhesive was applied to the backside of a 50.8-cm (20-inch) wide by 152.4-cm (60-inch) long piece of 50.8-μm (0.002-inch) thick dry erase laminating film (product no. X015420 available from Protect-all, Inc., Darien, Wis.) using a manual laminator (3M Model LS1050 available from 3M Company, St. Paul, Minn.). The resulting adhesive dry erase film was then laminated to the smooth side of the flexible backing sheet by feeding both between two rolls of a calendar (Falcon-36 available from Pro-Tech Engineering, Inc., Madison, Wis.) at room temperature such that the pressure sensitive adhesive on the backside of the dry erase laminating film contacted the smooth surface of the flexible backing sheet. The resulting laminate was 68.58 cm (27 inches) wide by 152.4 cm (60 inches) long, and comprised a 50.8-cm (20-inch) wide strip of dry erase film running lengthwise, roughly centered on the flexible backing sheet.

All four edges of the flexible backing sheet were cut with a razor blade to yield a laminate that was 60.96 cm (24 inches) wide by 142.24 cm (56 inches) long, comprising a 50.8-cm (20-inch) wide strip of dry erase film running lengthwise and centered with respect to the width of the laminate. A pressure sensitive transfer adhesive (Scotch™ Hi Strength Adhesive available from 3M Company, St. Paul, Minn.) was applied to the smooth side of the 5.08-cm (2-inch) strips of the laminate adjacent to both of the long edges of the laminate. A 2.54-cm (1-inch) strip adjacent to both of these edges was then folded over and the smooth surfaces were adhered with one another. The resulting dry erase sheet measured 55.88 cm (22 inches) wide by 142.24 cm (56 inches) long, and comprised a backside covered with mushroom type hooks and a dry erasable front side featuring upper and lower 2.54-cm (1-inch) framing strips covered with mushroom type hooks.

Example 5

Fabrication of a Repositionably Adhesive Dry Erase Sheet Having an Adhesively Bonded Frame Comprising a Self-Engaging Fastener Material A rectangular piece of a dry erase coated polyester film (product no. X015420 available from Protect-all, Inc., Darien, Wis.) was prepared, measuring 50.8 cm (20 in) wide by 91.4 cm (36 in) long. A pressure sensitive transfer adhesive (Scotch™ 300LSE Hi Strength Adhesive, available from 3M Company, St. Paul, Minn.) was applied to the smooth side of the snag resistant, self-engaging fastener material of Example 1 to create an adhesive-backed, snag resistant, self-engaging fastener material. Two strips of the adhesive-backed fastener material were cut measuring 2.54 cm (1 in) wide by 91.4 cm (36 in) long. Two shorter strips of the adhesive-backed fastener material were cut measuring 2.54 cm (1 in) wide by 45.7 cm (18 in) long. The two longer strips of adhesive-backed fastener material were applied to the dry erase coated side of the dry erase coated film adjacent and parallel to the long edges of the dry erase coated film. The two shorter strips of adhesive-backed fastener material were then applied to the dry erase coated side of the dry erase film adjacent and parallel to the short edges of the dry erase coated film. The overall color difference between the white dry erase coated film and the blue, snag resistant, self-engaging fastener material was measured using a GretagMacbeth™ SpectroEye™ spectrophotometer (available from GretagMacbeth, Regensdorf, Switzerland). The overall color difference between the dry erase coated film and the frame was $\Delta E^*=70$. The assembly comprising the dry erase coated sheet and the border strip passed the 3.2 mm mandrel bend test for flexibility.

Six foam squares measuring 2.54 cm (1 in) on each side (Scotch® Mounting Squares 111, available from 3M Company, St. Paul, Minn.), having a permanent pressure sensitive adhesive on one side and a repositionable pressure sensitive adhesive on the opposite side, were adhered to the back (i.e., non-dry erase coated) side of the dry erase article. The foam squares were adhered with the permanent adhesive side against the back side of the dry erase article, at positions near each corner and near approximately the midpoint of each of the long sides of the dry erase article. The resulting flexible dry erase article comprised a raised, 2.54-cm (1-in) wide, dark blue border comprising a repeating pattern of unordered cylindrical stems projecting outward from the top surface of the border, the border completely surrounding the dry erasable surface.

The dry erase article was hung on a painted vertical wall by pressing the repositionable adhesive side of the adhesive foam squares onto the wall surface. A small strip of adhesive-backed, snag resistant, self-engaging fastener material measuring approximately 1.27 cm (0.5 in) wide by 2.54 cm (1 in) long was adhered to a dry erase marker (Sanford Expo® Bold Color Dry Erase Marker, bullet tip, available from Sanford Corp., Bellwood, Ill.). The marker was then hung on the border strip of the dry erase article by mating the fastener material on the marker with that on the border of the dry erase article.

Example 6

Measurement of Force Required to "Over-Write" Various Framing Materials

The write-off resistances of several framing materials were characterized using the Marker Drag Force Test (described above). A sheet of a dry erase coated polyester film (product no. X015420 available from Protect-all, Inc., Darien, Wis.) measuring approximately 15.24 cm (6 in) wide by at least 22.86 cm (9 in) long was placed on the horizontal plane as described in the test method. In a first set of experiments, progressively thicker frames were built up on the dry erase substrate by applying successive layers of tape (3M™ Scotch® Blue Painter's Tape, 0.12 mm thick, available from 3M Company, St. Paul, Minn.) on top of each other. Tests were conducted between the application of successive layers of tape to measure the substrate friction force, $F_{f,substrate}$, the barrier force, $F_B$, and the frame friction force, $F_{f,frame}$, as described in the test method. These tests were designated as Tests 6.1-6.20, where the value after the decimal indicates the number of tape layers in the frame. The effectiveness of each frame was characterized as the difference between the barrier force and the substrate friction force ($F_B-F_{f,substrate}$, called the "surplus barrier force") and the difference between the frame friction force and the substrate friction force ($F_{f,frame}-F_{f,substrate}$, called the "surplus frame friction force"). In another test (designated Test 6.A), the same values were measured for the framing material of Example 1, which was attached to a dry erase coated substrate using a permanent pressure sensitive adhesive as described in Example 5. All of the measured values are shown in Table 4. (Two frame thickness values are given for Test 6.A; the first is the thickness of the base sheet of the fastener material, while the second is the total thickness including the base and the cylindrical stems.)

TABLE 4

Marker Drag Force Measurements for Various Framing Materials

| Test No. | Frame Thickness (mm) | $F_b$-$F_{f,substrate}$ (mN) | $F_{f,frame}$-$F_{f,substrate}$ (mN) |
|---|---|---|---|
| 6.1 | 0.12 | 944 | 2 |
| 6.2 | 0.23 | 1615 | −3 |
| 6.3 | 0.35 | 2515 | −7 |
| 6.5 | 0.58 | 3599 | −4 |
| 6.8 | 0.92 | 4877 | −6 |
| 6.12 | 1.38 | 6779 | −9 |
| 6.16 | 1.84 | 7680 | −5 |
| 6.20 | 2.30 | 8315 | −3 |
| 6.A | Base: 0.20<br>Total: 1.78 | 3573 ± 158 | 111 ± 6 |

The surplus barrier force increased with the frame thickness for Tests 6.1-6.20. At overall frame thicknesses greater than approximately 0.5 mm, the frames provided a significant tactile barrier, enabling a user to easily perceive that the marker tip had engaged the step formed by the edge of the frame and indeed stopping the marker at reasonable writing speeds. However, the smooth masking tape making up the frame of Tests 6.1-6.20 provided little tactile cue once the marker tip had engaged the edge of the framing strip and moved onto its top surface, as quantified by the negligible surplus frame friction force for these tests.

In contrast, the data from Test 6.A show that it provided a significant surplus barrier force as well as a significant surplus frame friction force due to the rough texture provided by the outwardly projecting cylindrical stems on its surface. This example demonstrates the value of both the thickness and the surface texture of the framing material in helping to prevent edge "over-writing."

Example 7

Erasure of Dry Erase Markings on Dry Erase Sheets With and Without Frames

Two rectangular pieces of a dry erase coated polyester film (product no. X015420 available from Protect-all, Inc., Darien, Wis.) were prepared, measuring 25.4 cm (10 in) wide by 50.8 cm (20 in) long. A pressure sensitive transfer adhesive (Scotch™ 300LSE Hi Strength Adhesive, available from 3M Company, St. Paul, Minn.) was applied to the smooth side of the snag resistant, self-engaging fastener material of Example 1 to create an adhesive-backed, snag resistant, self-engaging fastener material. A strip of the adhesive-backed fastener material was cut measuring 2.54 cm (1 in) wide by 25.4 cm (10 in) long. The strip of fastener material was adhered adjacent and parallel to one of the short edges of one of the pieces of dry erase coated film.

Both pieces of dry erase film (one with no border material designated Sample 7.A, and one with a strip of border material along one edge designated Sample 7.B) were hung on a wall with the short edges parallel to the floor, using double-sided tape. Sample 7.B was hung such that the border strip was along the edge of the dry erase sheet nearest the floor. A piece of standard 8.5-in by 11-in copier paper (HammerMille CopyPlus™ available from International Paper Company, Stamford, Conn.) was hung beneath each of the pieces of dry erase film using double-sided tape, with a short edge of the paper parallel to the floor and a the top edge of each piece of paper underneath the bottom of the corresponding piece of dry erase film with an overlap of roughly 1.27 cm (0.5 in).

Forty parallel, horizontal lines were made on Sample 7.B using a dry erase marker (Sanford Expo® Bold Color Dry Erase Marker, chisel tip, available from Sanford Corp., Bellwood, Ill.). The pattern of parallel lines started 1 cm above the top edge of the border strip and extended upward with a spacing of 1 cm between adjacent lines. An approximately identical pattern of horizontal lines was made on Sample 7.A. The markings were allowed to dry for 10 minutes. Then, a clean felt eraser was used to erase each pattern of lines using only downward strokes.

On Sample 7.B, it was found that the border was very effective in stopping the eraser from moving below the lower edge of the sheet. In fact, it was quite difficult to force the eraser to move across the outward surface of the border strip due to "catching" of the felt fibers by the outwardly projecting cylindrical stems on the border surface. Following erasure, black ink dust was observed along the upper edge of the border strip, where it was concentrated by the downward movement of the eraser. On Sample 7.A, care was taken during the initial erasure to avoid moving the lower edge of the eraser past the lower edge of the dry erase sheet. This resulted in a clearly visible "band" of black ink dust, approximately 1 cm wide, near the lower edge of the sheet.

In a second erasure step conducted on both samples, the felt eraser was moved quickly and forcibly across the surface of the sheet in an up-and-down motion to simulate the motion of a "careless" user. In this step, the eraser was allowed to approach the edge of the sheet forcibly, and indeed to move off the sheet. The border material of Sample 7.B was found to effectively prevent the eraser from moving over its surface and past the edge of the sheet. In contrast, some eraser strokes performed on Sample 7.A did cause the eraser to pass partially over the edge of the sheet, creating a visible "halo" of black ink dust on the piece of copier paper underneath that extended roughly 11 cm from the bottom edge of the sheet. No such halo was visible on the piece of copier paper underneath Sample 7.B.

Figure 6:
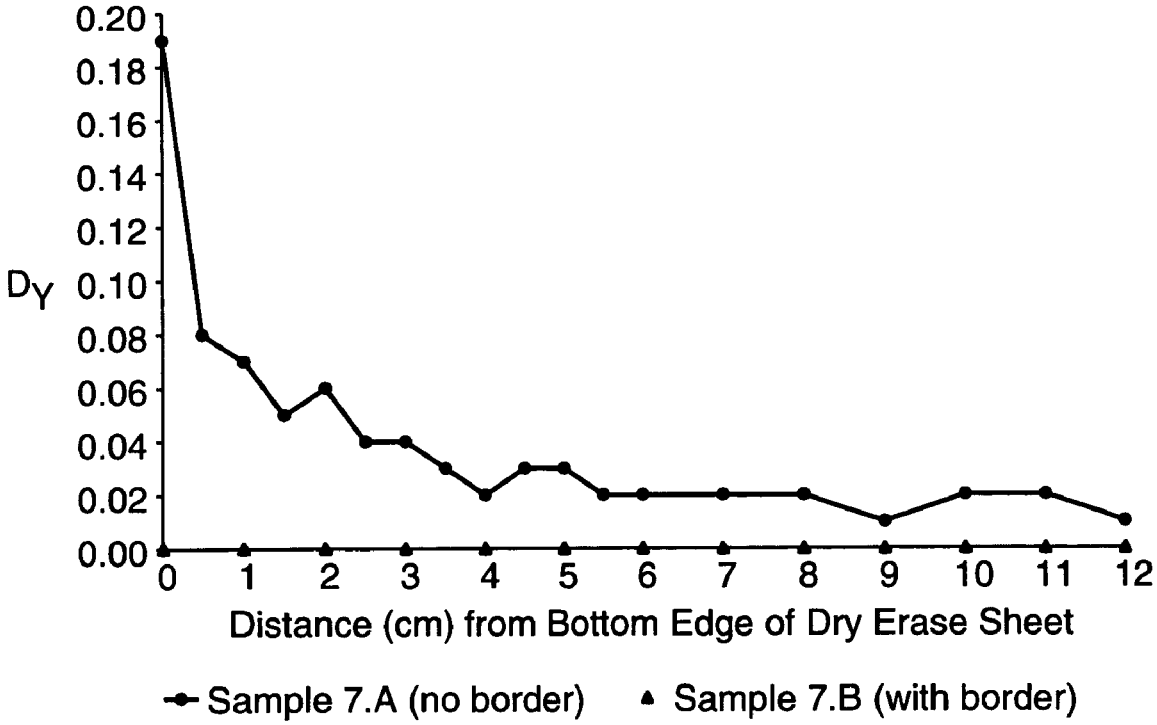
FIG. 6 is a plot showing the optical density of dry erase marker ink.

The quantity of black ink dust on each piece of copier paper was quantified using an optical spectrophotometer GretagMacbeth™ SpectroEye™ (available from GretagMacbeth, Regensdorf, Switzerland) in densitometer mode. Operating with the ANSI T optical density standard, the optical density of the ink-covered paper was measured relative to that of a clean sheet of copier paper at intervals of 0.5 cm in distance from the position on each piece of copier paper that was underneath the edge of the corresponding dry erase sheet sample. The optical densities, $D_y$, are shown in FIG. 6.

This example demonstrates the effectiveness of the framing materials of this invention in helping to prevent deposition of ink dust on the support surface (e.g., the wall) by deposition from the eraser.

Although the present invention has been described with reference to preferred embodiments, workers skilled in the art will recognize that changes may be made in form and detail without departing from the spirit and scope of the invention.

What is claimed is:

1. A display article comprising:

a flexible substrate including a writing surface capable of being used as a dry erase surface, and a peripheral edge extending around the writing surface; and a flexible framing strip affixed to the writing surface at a position proximate to the peripheral edge wherein the flexible framing strip further comprises an inner surface disposed against the writing surface; an outer surface opposite the inner surface; and an attachment mechanism disposed on the outer surface of the flexible framing strip.

2. The article of claim 1 wherein the framing strip is comprised of a polyolefin or a blend thereof.

3. The article of claim 1 wherein the attachment mechanism comprises:

a plurality of hooks.

4. The article of claim 3 wherein each of the hooks comprises:

a stem; and a mushroom shaped head.

5. The article of claim 1 wherein the attachment mechanism comprises:

a plurality of columns having a substantially constant cross-section.

6. The article of claim 1 wherein the attachment mechanism comprises:

a plurality of cylindrical stems having a substantially constant cross-section.

7. The article of claim 1 wherein the attachment mechanism comprises:

an arrangement of unordered columns that repeats on a substrate, wherein the columns have substantially constant cross-sections.

8. The article of claim 1 wherein the attachment mechanism comprises:

a repositionable pressure sensitive adhesive.

9. The article of claim 1 wherein the flexible substrate further comprises:

a back surface opposite the writing surface; and wherein a portion of the flexible substrate is folded over so as to form the framing strip, thereby exposing a portion of the back surface.

10. The article of claim 1 and further comprising:

a back surface opposite the writing surface; and a mounting mechanism disposed on the back surface.

11. The article of claim 10 wherein the mounting mechanism comprises:

a repositionable pressure sensitive adhesive.

12. The article of claim 10 wherein the mounting mechanism comprises:

a plurality of hooks.

13. The article of claim 12 wherein each of the hooks comprises:

a stem; and a mushroom shaped head.

14. The article of claim 10, wherein the mounting mechanism extends substantially across the entire back surface.

15. The article of claim 1 wherein the substrate has a flexibility of at least 6.4 mm as measured by the Mandrel Bend Test.

16. The article of claim 1 wherein the writing surface further comprises:

a first layer of dry erase coating disposed on the substrate.

17. The article of claim 16 wherein the dry erase coating is selected from the group consisting of:

radiation curable hardcoat films and fluoropolymer coatings.

18. The article of claim 1 wherein the peripheral edge comprises:

first and second opposing edges and third and fourth opposing edges.

19. The article of claim 18 wherein the framing strip extends generally parallel to the first and second opposing edges.

20. The article of claim 18 wherein the framing strip extends generally parallel to the first, second, third and fourth edges.

21. The article of claim 1 wherein the framing strip extends substantially along the entire peripheral edge.

22. The article of claim 1, formed into a roll.

23. The article of claim 1, wherein the flexible framing strip is comprised of a material selected from the group consisting of:

plastic tapes, open and closed cell foams, nonwoven fabrics, woven fabrics, plastic coated fabrics, and cork.

24. A method for making a presentation article comprising:

forming a substrate having a writing surface defining a periphery, a back surface, a plurality of mushroom shaped hooks extending from the back surface substantially over the entire back surface, wherein the writing surface is capable of being used as a dry erase surface;

folding over at least a portion of the periphery of the writing substrate to form a framing strip having a plurality of exposed mushroom shaped hooks; and securing the framing strip to the writing surface.

* * * * *

UNITED STATES PATENT AND TRADEMARK OFFICE

CERTIFICATE OF CORRECTION

PATENT NO. : 7,399,184 B2
APPLICATION NO. : 11/165409
DATED : July 15, 2008
INVENTOR(S) : Jonathan F. Hester It is certified that error appears in the above-identified patent and that said Letters Patent is hereby corrected as shown below:

Column 2
Line 31, delete "WV" and insert -- UV --, therefor.

Column 4
Line 59, delete "varety" and insert -- variety --, therefor.

Column 9
Line 8, delete "one one" and insert -- on one --, therefor.
Line 23, delete "one one" and insert -- on one --, therefor.

Column 14
Line 48, delete "fmely" and insert -- finely --, therefor.

Column 20
Line 11, delete "$F_b$" and insert -- $F_B$ --, therefor.
Line 64, delete "(HammerMille" and insert -- (HammerMill® --, therefor.

Column 21
Line 1, after "and" delete "a".

Signed and Sealed this

Sixteenth Day of December, 2008

JON W. DUDAS
*Director of the United States Patent and Trademark Office*